US005493275A

United States Patent [19]

Easter

[11] Patent Number: 5,493,275

[45] Date of Patent: Feb. 20, 1996

[54] APPARATUS FOR DEACTIVATION OF ELECTRONIC ARTICLE SURVEILLANCE TAGS

[75] Inventor: Ronald B. Easter, Parkland, Fla.

[73] Assignee: Sensormatic Electronics Corporation, Deerfield Beach, Fla.

[21] Appl. No.: 287,772

[22] Filed: Aug. 9, 1994

[51] Int. Cl.[6] ..... G08B 13/14

[52] U.S. Cl. ..... 340/572; 340/551; 361/149; 361/152; 361/267

[58] Field of Search ..... 340/572, 551; 361/151, 149, 150, 152, 267

[56] References Cited

U.S. PATENT DOCUMENTS

| | | | |
|---|---|---|---|
| 3,983,552 | 9/1976 | Bakeman, Jr. et al. | 340/551 |
| 4,218,722 | 8/1980 | Yoshizawa | 361/149 |
| 4,617,603 | 10/1986 | Johnson et al. | 361/267 |
| 4,621,299 | 11/1986 | Hill | 361/151 |
| 5,341,125 | 8/1994 | Plonsky et al. | 340/572 |
| 5,357,398 | 10/1994 | Kamijoh | 361/149 |

*Primary Examiner*—John K. Peng
*Assistant Examiner*—Benjamin C. Lee
*Attorney, Agent, or Firm*—Robin, Blecker, Daley & Driscoll

[57] ABSTRACT

A deactivator for deactivating electronic article surveillance tags includes a deactivating coil, drive circuitry controllable for supplying driving signals to the deactivating coil, a reference signal generator for generating a reference signal having preselected characteristics varying with time, a comparator for comparing characteristics of the driving signals with the reference signal characteristics, and a control unit for controlling the drive circuitry in accordance with signal comparisons effected by the comparator.

14 Claims, 4 Drawing Sheets t1

APPARATUS FOR DEACTIVATION OF ELECTRONIC ARTICLE SURVEILLANCE TAGS

FIELD OF THE INVENTION

This invention relates generally to electronic article surveillance and pertains more particularly to so-called "deactivators" for rendering electronic article surveillance tags inactive.

BACKGROUND OF THE INVENTION

It has been customary in the electronic article surveillance (EAS) industry to apply to articles to be monitored either hard, reusable EAS tags or disposable adhesive EAS labels, both functioning as article monitoring devices. A checkout clerk passes the article over or into deactivation apparatus which deactivates the monitoring device.

Known deactivation apparatus includes coil structure energizable to generate a magnetic field of magnitude sufficient to render the monitoring device inactive, i.e., no longer responsive to incident energy itself to provide output alarm or to transmit an alarm condition to an alarm unit external to the tag or label (hereinafter "tag").

One commercial deactivator of the assignee hereof employs one coil disposed horizontally within a housing and tagged articles are moved across the horizontal top surface of the housing such that the tag is disposed generally coplanarly with the coil.

Another commercial deactivator of the assignee hereof employs a housing having an open side with a plastic bucket inserted in the housing such that an article or a plurality of articles may be made resident in the bucket. Three coil pairs are disposed about the bucket in respective x-, y- and z-axis planes, whereby orientation of the tag as in the first discussed deactivator is not required.

The prior art has come to appreciate the desirability of the amplitude envelope of the current used for driving deactivating coils shaped so as to decay linearly from a given maximum to zero in a specified time interval resulting in a given decay rate. The magnetic field generated will exhibit the same shape as the driving current, i.e., a sawtooth current waveform, the peaks of which define the desired amplitude envelope.

One known past approach to driving current amplitude envelope shaping involves an elaborate microprocessor based system. An H-bridge of power transistors is employed to drive the deactivating coil at levels of tens of amperes. Current values are measured and compared with a digital look up table of peak current values defining the desired current amplitude envelope. The H-bridge transistors are controlled in accordance with the comparison results by digital switching.

From applicant's perspective, the prior art approach is unduly complicated and costly. Further, significant and undesired electronic noise is generated therein due to the microprocessor and associated digital switching.

SUMMARY OF THE INVENTION

It is a primary object of the present invention to provide improved and simplified deactivators for EAS usage.

A more particular object of the invention is the provision of simplified circuitry for controlling the driving current envelope of EAS tag deactivating coils.

In attaining the foregoing and other objects, the invention provides a deactivator for deactivating electronic article surveillance tags, comprising a deactivating coil, drive means controllable for supplying driving signals to the deactivating coil, reference signal generator means for generating a reference signal having preselected characteristics varying with time, comparator means for comparing characteristics of the driving signals with the reference signal characteristics, and control means for controlling the drive means in accordance with signal comparisons effected by the comparator means.

The reference signal generator preferably generates as the reference signal a ramp signal having amplitudes decreasing with time. The comparator means preferably includes a sensing element in effective series connection with the deactivating coil and providing output signals indicative of amplitudes of the driving signals. The comparator means further includes an amplitude comparator circuit receiving the sensing element output signals and the reference signal.

The reference signal contains full definition of the desired driving current amplitude envelope. The comparator means accordingly conforms driving current peak amplitudes to decaying amplitude values with the passage of time, given the decaying input thereto from the reference signal. The invention will thus be seen to attain the results of the prior microprocessor based deactivator in a quite simple arrangement which involves less electronic noise generation.

The foregoing and other objects and features of the invention will be further understood from the following detailed description of preferred embodiments thereof and from the drawings, wherein like reference numerals identify like components throughout.

DETAILED DESCRIPTION OF PREFERRED EMBODIMENTS AND PRACTICES

Figure 1:
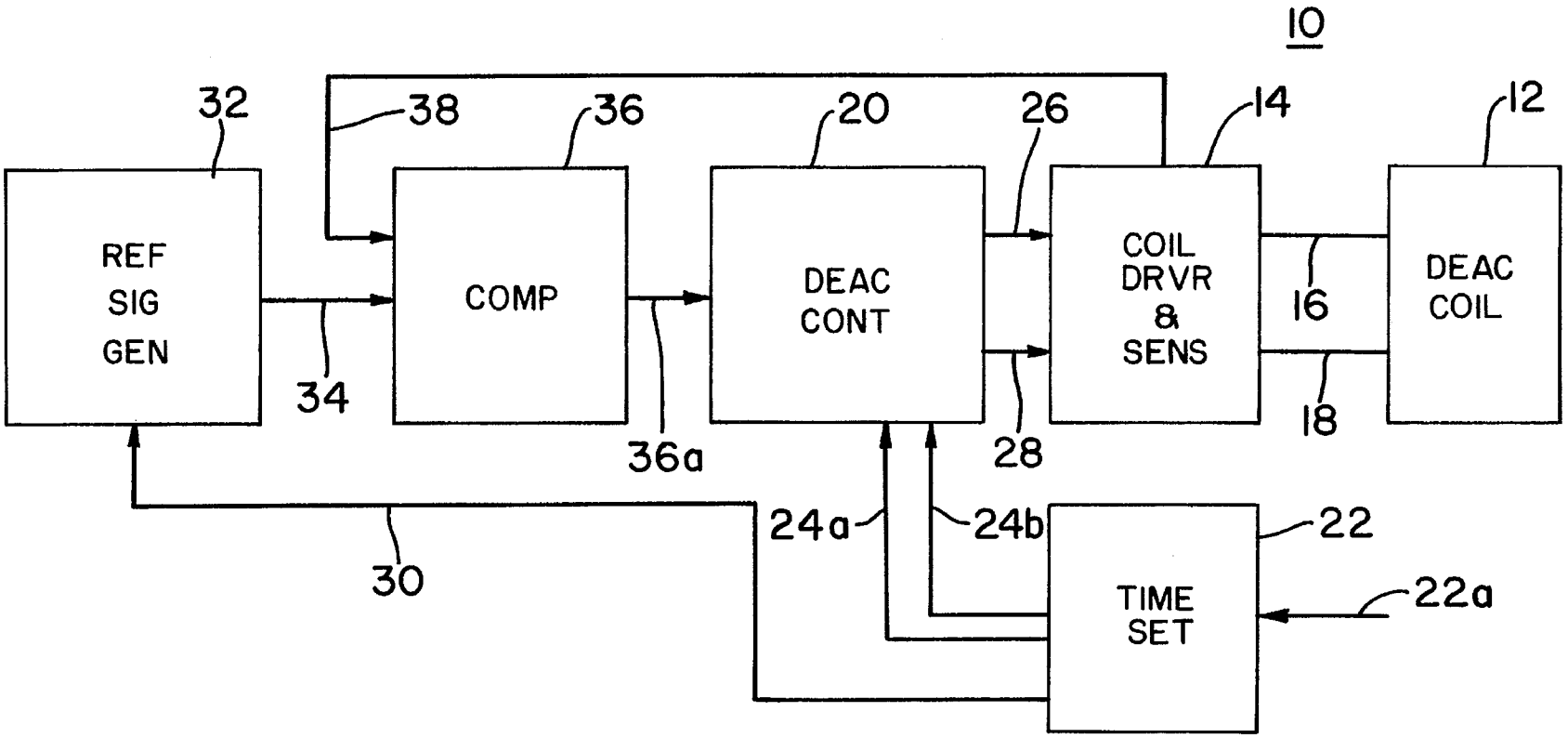
FIG. 1 is a general block diagram of a deactivator in accordance with the invention.

Referring to FIG. 1, deactivator 10 has deactivator coil (DEAC COIL) 12 which is energized and drive current-sensed by coil driver and sensor (COIL DRVR & SENS) 14 over lines 16 and 18. Deactivation controller (DEAC CONT) 20 receives time-based inputs from time setting unit (TIME SET) 22 over lines 24*a* and 24*b* and provides control inputs to coil driver and sensor 14 over lines 26 and 28.

Time setting unit 22 further provides input over line 30 to reference signal generator 32, which provides its output reference signal on line 34 to comparator (COMP) 36. Comparator receives a further input signal from coil driver and sensor 14 over line 38.

Figure 2:
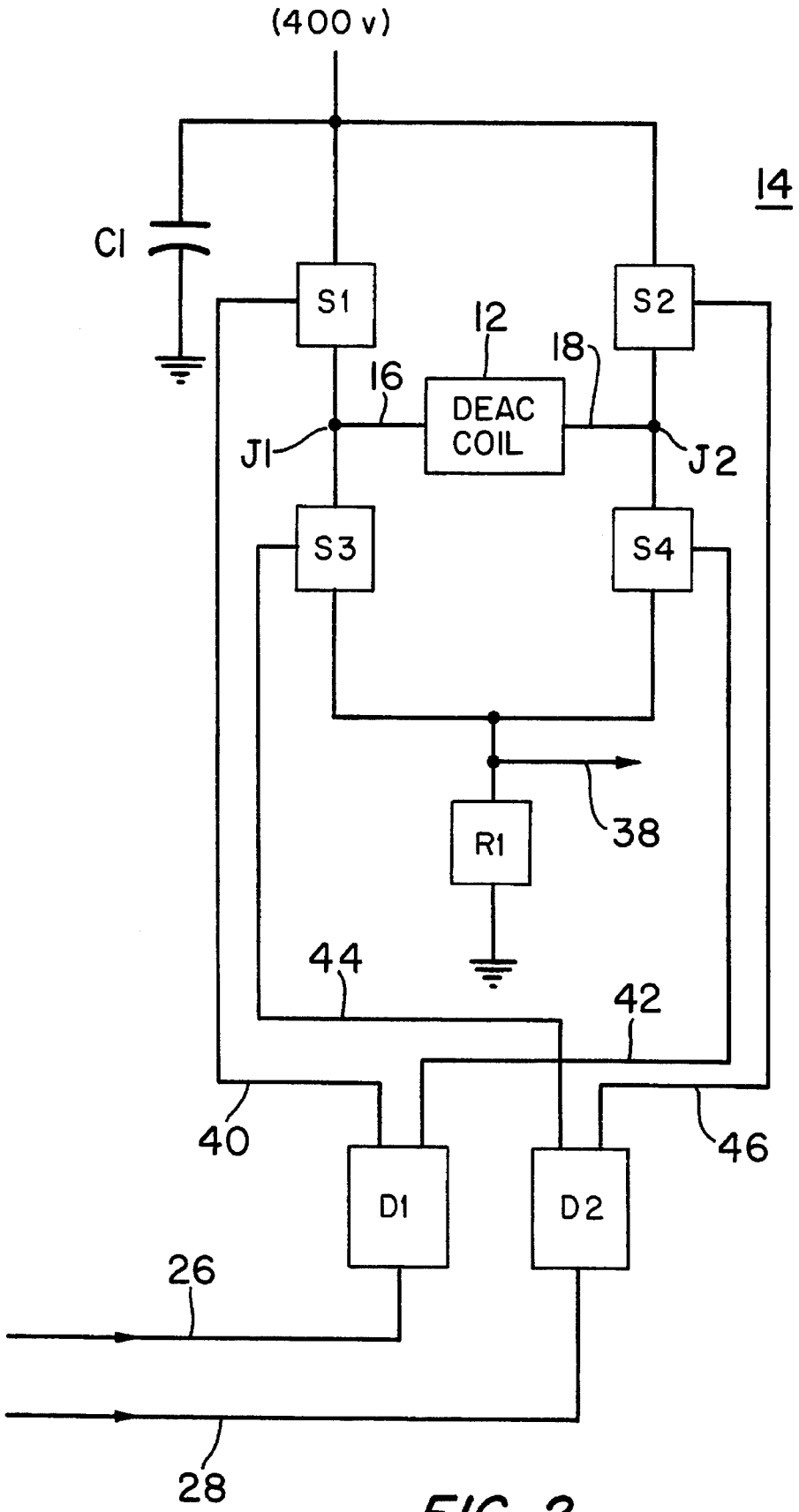
FIG. 2 is a detailed block diagram of coil driver and sensor 14 of FIG. 1 in connection with deactivating coil 12 of FIG. 1.

Turning to FIG. 2, coil driver and sensor 14 operates from a high voltage power supply (400 v) having capacitor C1 coupled to ground. Two circuit branches are provided, a first having electronic switches S1 and S3 series connected therein and a second having electronic switches S2 and S4 series connected therein. The switches are preferable constituted by semiconductive field effect devices, such as insulated gate bipolar units, one being HGTG24N60D1D, commercially available from Harris Semiconductor. The switches are of common polarization, e.g., NPN-type. Deactivation coil 12 is connected by lines 16 and 18 respectively to the junctions J1 and J2 of the circuit branches. As will be appreciated, when switches S1 and S4 are conductive, current flows in a first direction through deactivation coil 12. Conversely, when switches S2 and S3 are conductive, current flows in a second direction through deactivation coil 12, the second direction being opposite to the first direction.

Sensing resistor R1 is in effective series connection with each of the two circuit branches and, irrespective of the directionality of deactivation coil current, always sees current in one direction. The voltage across sensing resistor R1 is furnished on output line 38 of coil driver and sensor 14.

The inputs to coil driver and sensor 14 on lines 26 and 28 are furnished respectively to drivers D1 and D2. Driver D1 provides gating signals on lines 40 and 42 respectively to switches S1 and S4, rendering these switches conductive. Driver D2 provides gating signals on lines 44 and 46 respectively to switches S3 and S2, rendering these switches conductive. With the switches constituted as insulated gate bipolar units, lines 40, 42, 44 and 46 are connected to the gate terminals thereof.

Figure 3:
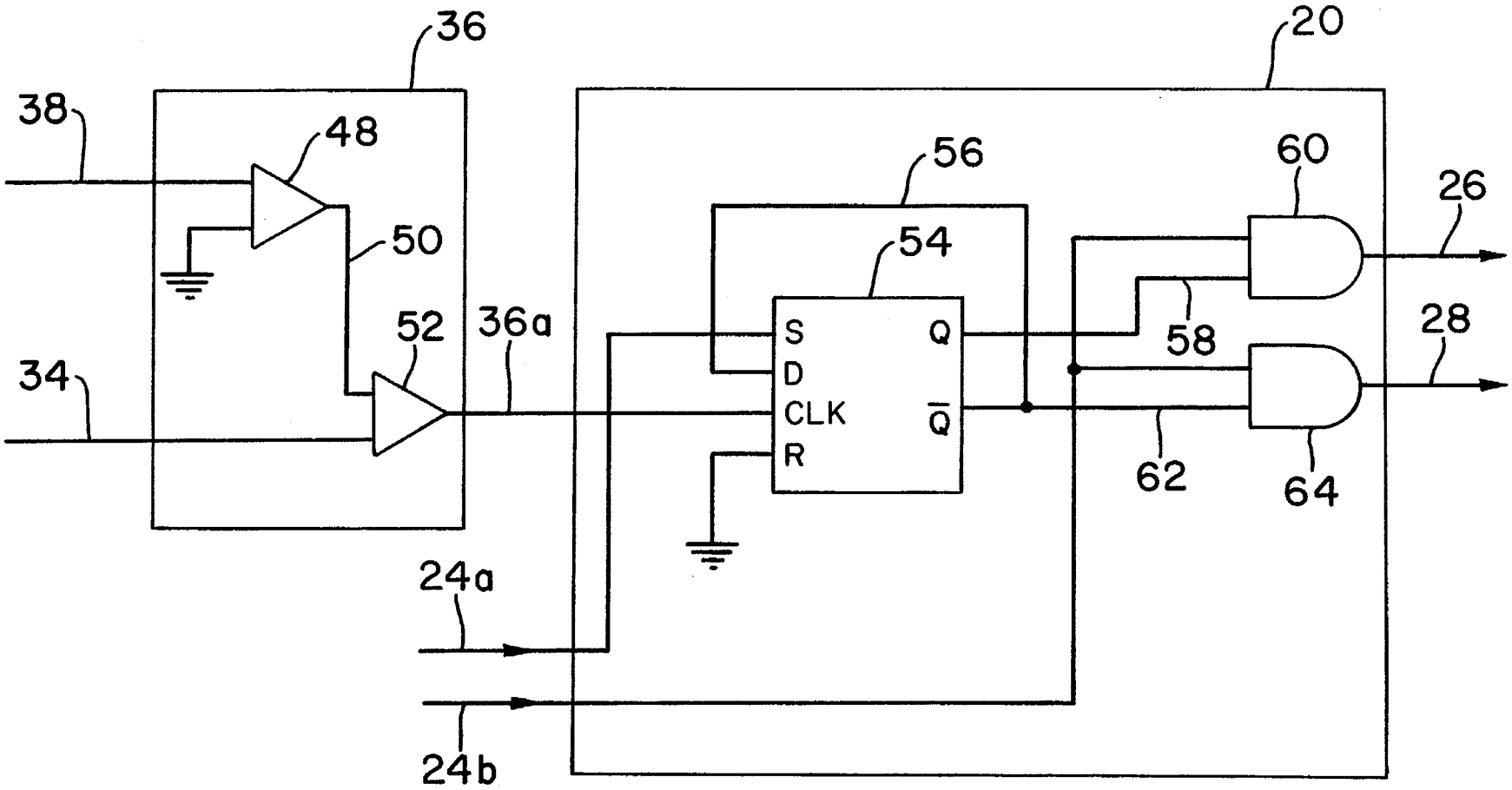
FIG. 3 is a detailed block diagram of controller 20 and comparator 36 of FIG. 1.

Preferred circuit arrangements of comparator 36 and deactivation controller 20 are shown in FIG. 3. Comparator 36 includes amplifier 48 which scales the output of sensing resistor R1 on input line 38 and provides the amplified output on line 50. Comparator circuit 52 compares the amplitude of the line 50 signal with the amplitude of the signal on input line 34, i.e., the output of reference signal generator 32 of FIG. 1, and comparator output line **36*a*** provides signals indicative of the comparisons.

Deactivation controller 20 includes flip-flop 54 having its S terminal connected to line **24*a*, its R terminal connected to ground, its CLK (clock) terminal connected to line 36*a* and its D terminal connected by line 56 to its Q-bar terminal. The Q terminal of flip-flop 54 is connected to the line 58 input to AND gate 60. The Q-bar terminal of flip-flop 54 is connected to the line 62 input to AND gate 64. Second inputs to gates 60 and 64 are provided by line 24*b* and the gate outputs are connected respectively to lines 26 and 28**.

In operation of deactivator 10, time set unit 22 receives an input signal over input line **22*a*, indicating that a tag is present at the deactivator for deactivation. Prior art deactivators, such as that first discussed above, and the subject deactivator, include transmit/receive coils and associated processing circuitry for detecting the presence of a tag and furnishing the line 22*a*** signal.

Figures 4A, 4B, 4C, 4D, 4E, 4F, 4G:
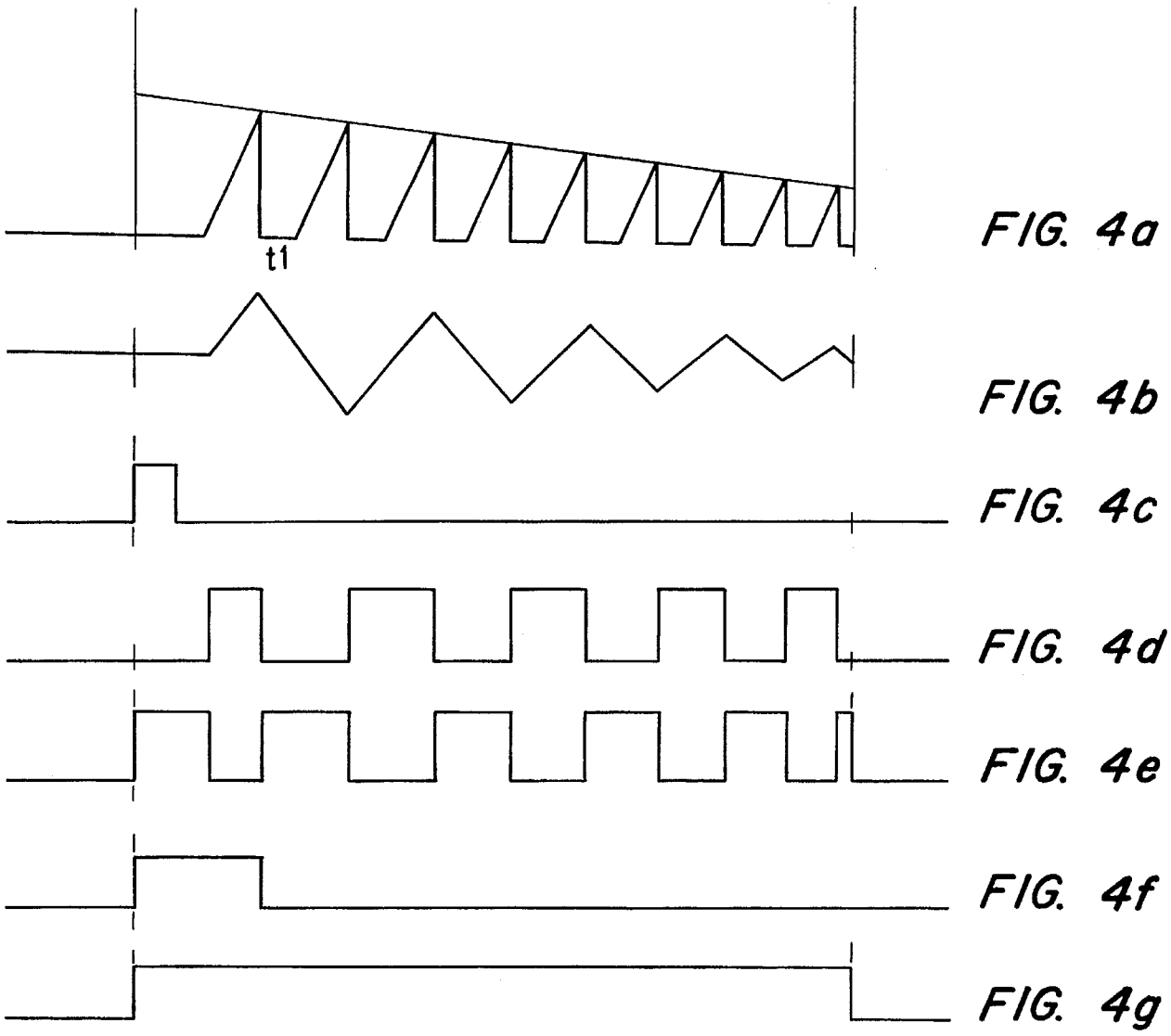
FIGS. 4*a* through 4*g* are timing diagrams of various signals present in the deactivator of FIG. 1.

On receipt of the line **22*a* signal, time set unit 22 generates a signal on line 30, indicated in FIG. 4*c* for initiating operation of reference signal generator 32, e.g., a declining amplitude ramp, such as is shown atop FIG. 4*a*. Unit 22 also is responsive to the line 22*a* signal to generate signals on lines 24*a* and 24*b*, such as are shown respectively in FIGS. 4*f* and 4*g***.

The line **24*a* signal sets flip-flop 54 concurrently with the initiation of operation of reference signal generator 12. This is seen in FIG. 4*d*, which indicates the state of the line 58 input to gate 60, i.e., the Q output of the flip-flop. Since both inputs to gate 60 are HI (line 24*b* is HI throughout the cycle—FIG. 4*g*), gate 60 output line 26 is HI and driver D1 is enabled, in turn rendering switches S1 and S4 conductive and supplying driving current to deactivation coil 12. The driving current is seen below the ramp in FIG. 4*a***.

At the point in time that amplifier 48 indicates that the scaled voltage across sensing resistor R1 has reached the then existing ramp voltage, i.e., at t1 in FIG. **4*a*, comparator 52 changes the state of line 36*a*, toggling flip-flop 54 to have its Q-bar output HI. This sets current through amplifier 48 to nil. Concurrently, gate 28 is enabled and it enables driver D2, rendering switches S2 and S3 conductive and reversing current flow through deactivation coil 12. The cycle repeats until the next correspondence of scaled voltage across sensing resistor from amplifier 48** equaling the then existing, lower ramp voltage, whereupon the flip-flop is again changed in state, causing driver D1 to again render switches S1 and S4 conductive.

The process continues as evidenced in FIG. **4*a*, giving rise to the coil driving current shown in FIG. 4*b*. As the reference signal approaches zero, time set unit 22 discontinues the enabling signal on line 24*b*, as indicated in FIG. 4*g***.

By way of summary and introduction to the ensuing claims, the invention will be seen to provide a deactivator for deactivating electronic article surveillance tags, comprising a deactivating coil, drive means controllable for supplying driving signals to the deactivating coil, reference signal generator means for generating a reference signal having preselected characteristics varying with time, comparator means for comparing characteristics of the driving signals with the reference signal characteristics and control means for controlling the drive means in accordance with signal comparisons effected by the comparator means.

The reference signal generator preferably generates, as the reference signal, a ramp signal having amplitudes decreasing with time, the amplitudes constituting the reference signal characteristics.

The drive means includes a sensing element in effective series connection with the deactivating coil and providing output signals indicative of characteristics of the driving signals.

The comparator means includes a comparator circuit receiving the sensing element output signals and the reference signal and comparing respective amplitudes thereof when amplitude is selected to be the particular signal characteristic.

The control means includes bistable circuit means for changing state in accordance with signal comparisons effected by the comparator means. The control means further includes first and second gate circuits connected independently to the bistable circuit means.

The deactivator includes a time set unit operatively responsive to an input signal indicative of the presence of an electronic article surveillance tag at the deactivator to initiate operation of the reference signal generator means, to apply a set signal to the bistable circuit means and to enable the first and second gate circuits.

The drive means comprises first and second driving circuits connected respectively to output terminals of the first and second gate circuits and has first and second branch circuits, the first branch circuit having first and second series-connected switches, the second branch circuit having first and second series-connected switches, the deactivation coil having first and second terminals connected respectively to a junction of the first branch switches and to a junction of the second branch switches.

The invention will also be seen to have method aspects for generating a magnetic field for use in deactivating electronic article surveillance tags wherein the field decays linearly from a given maximum to zero in a specified time interval resulting in a given decay rate. The method includes steps of providing a deactivation coil, generating an analog signal having amplitude varying with time over the specified time interval, generating driving current for the deactivation coil to have an amplitude envelope varying with time correspondingly with the amplitude of the analog signal and supplying the driving current to the deactivation coil.

The second above step is practiced by generating the analog signal to have amplitude decreasing linearly with time over the specified time interval. The third above step is practiced in part by comparing the amplitude of the driving current to the amplitude of the analog signal. The last above step is practiced by changing the direction of the driving current in the deactivation coil correspondingly with the results of comparing the amplitude of the driving current to the amplitude of the analog signal.

Various changes to the particularly disclosed embodiments and practices may evidently be introduced without departing from the invention. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. A deactivator for deactivating electronic article surveillance tags, comprising:

(a) a deactivating coil;

(b) drive means controllable for supplying diving current signals to said deactivating coil;

(c) reference signal generator means for generating a continuous reference signal having preselected characteristics of decreasing amplitude over time;

(d) comparator means for comparing amplitude characteristics of said driving current signals with said reference signal amplitude characteristics; and (e) control means for controlling said drive means in accordance with signal comparisons effected by said comparator means to selectively change the direction of said driving signals to conform an envelope of said driving current signals to said reference signal amplitude characteristics.

2. The deactivator claimed in claim 1, wherein said control means includes bistable circuit means for changing state in accordance with signal comparisons effected by said comparator means and changing supply of said driving signals to said deactivating coil correspondingly with changed state of said bistable circuit means.

3. The deactivator claimed in claim 2, wherein said control means further includes first and second gate circuits connected independently to said bistable circuit means for controlling the state of said bistable circuit means.

4. The deactivator claimed in claim 3, further including a timing controller operatively responsive to an input signal indicative of the presence of an electronic article surveillance tag at said deactivator to initiate operation of said reference signal generator means, to apply a set signal to said bistable circuit means and to enable said first and second gate circuits.

5. The deactivator claimed in claim 4, wherein said drive means comprises first and second driving circuits connected respectively to output terminals of said first and second gate circuits for supplying said driving signals to said deactivating coil.

6. The deactivator claimed in claim 5, wherein said drive means further comprises first and second branch circuits, said first branch circuit having first and second series-connected switches, said second branch circuit having first and second series-connected switches, said deactivation coil having first and second terminals connected respectively to a junction between said first branch switches and to a junction of said second branch switches.

7. The deactivator claimed in claim 1, wherein said reference signal generator generates as said reference signal a ramp signal having amplitudes decreasing with time, said amplitudes constituting said reference signal characteristics.

8. The deactivator claimed in claim 7, wherein said drive means includes a sensing element in series connection with said deactivating coil and providing output signals indicative of amplitudes of said driving signals, said amplitudes constituting said driving signal characteristics.

9. The deactivator claimed in claim 8, wherein said comparator means includes an amplitude comparator circuit receiving said sensing element output signals and said reference signal.

10. The deactivator claimed in claim 1, wherein said drive means includes a sensing element in series connection with said deactivating coil and providing output signals indicative of characteristics of said driving signals.

11. The deactivator claimed in claim 10, wherein said comparator means includes a comparator circuit receiving said sensing element output signals and said reference signal.

12. A method for generating a magnetic field for use in deactivating electronic article surveillance tags, comprising the steps of:

(a) providing a deactivation coil;

(b) generating an analog signal having amplitude continuously varying with time from a given maximum to a given minimum in a specified time interval;

(c) generating a continuous driving signal current selectively changing in direction for said deactivation coil to have an amplitude envelope varying with time correspondingly with said amplitude of said analog signal; and (d) supplying said continuous driving signal current to said deactivation coil and thereby establishing a magnetic field selectively changing in direction and decaying from a given maximum to a given minimum in said specified time interval.

13. The method claimed in claim 12, wherein said step (b) is practiced by generating said analog signal to have amplitude decreasing linearly with time over said specified time interval.

14. The method claimed in claim 13, wherein said step (c) is practiced in part by comparing the amplitude of said driving current to the amplitude of said analog signal.

* * * * *